United States Patent [19]

Ross

[11] 4,084,338

[45] Apr. 18, 1978

[54] VEHICLE-TOP SIGN DISPLAY ASSEMBLY

[76] Inventor: David J. Ross, 60 Willy Ave., Liberty, N.Y. 12754

[21] Appl. No.: 707,828

[22] Filed: Jul. 22, 1976

[51] Int. Cl.[2] ..... G09F 21/04

[52] U.S. Cl. ..... 40/592; 40/606; 40/611

[58] Field of Search ..... 40/129 C, 125 H, 125 R, 40/125 F, 145 R, 125 C

[56] References Cited

U.S. PATENT DOCUMENTS

| | | | |
|---|---|---|---|
| 1,851,046 | 3/1932 | Horni | 40/145 R |
| 3,116,027 | 12/1963 | Kleppin | 40/145 R X |
| 3,153,294 | 10/1964 | Hay et al. | 40/129 C |
| 3,392,467 | 7/1968 | Hawes | 40/129 C |

*Primary Examiner*—John F. Pitrelli
*Attorney, Agent, or Firm*—Martha G. Pugh

[57] ABSTRACT

A vehicle-top sign display assembly which is constructed to support a pair of signs in arched back-to-back relation. The assembly includes a pair of corner supports which accommodate opposite vertical edges of the signs in sandwich relation with a pair of wedge-shaped members interposed internally between the signs. A pair of spreaders are disposed transversely across the top and bottom of the assembly to maintain the centers of the signs spaced apart. Each of these includes two pairs of grippers which accommodate the upper and lower horizontal edges of the signs.

8 Claims, 9 Drawing Figures

VEHICLE-TOP SIGN DISPLAY ASSEMBLY

BACKGROUND OF THE INVENTION

This invention relates in general to signs carried by vehicles and, more particularly, to car-top signs.

A well-known device for conveying advertising information is by signs attached to vehicles. The principal requirements for such a sign are a rigid frame which is capable of being simply and securely fastened to the vehicle top without damaging the finish, and which is adapted to hold the sign securely in place in a position readily visible to the public, notwithstanding stresses imposed by vehicular speed and wind.

Many carriers of car-top signs are available in the prior art; but they have certain disadvantages in that in some cases they require the assembly of a complex frame having a large number of parts; and in other cases, the sign assembly is not properly supported, streamlined and secured to avoid the hazard of the signs or frame assembly rupturing and flying off when the vehicle is moving.

SUMMARY OF THE INVENTION

It is, therefore, a principal object of this invention to provide an improved vehicle-top sign; more particularly, one which is quickly and easily assembled, which will securely hold one or more signs in a streamlined, vibration-resistant frame in a highly visible position atop a vehicle.

It is a further object of the invention to provide a frame in which signs can be readily installed and removed without disassembling the entire frame.

These and other objects are achieved in accordance with the present invention in a vehicle-top sign display assembly which is designed to simultaneously display a pair of signs in arched back-to-back relation, mounted along the principal axis of the vehicle. The frame comprises a pair of vertically extended corner supports having V-shaped sections. The corner supports, which are mounted in cantilever fashion, are disposed to accommodate the lateral edges of a pair of signs in sandwched relation with a pair of vertically standing, wedge-shaped, internal supporting members at each of the ends. The latter may be held in spaced-apart relation by a pair of internal horizontal struts. Intermediate between the two ends is a pair of spreaders, disposed in parallel relation transversely across the top and bottom of the assembly, each of which is equipped with a series of grips on each side which include aligned slots for holding the upper and lower edges of the signs securely in position.

The principal features of this invention are that the frame is quickly and easily installed on the roof of the vehicle top, providing a highly visible, streamlined, vibration-resistant mounting in which a pair of signs can be removably secured.

These and other features of the invention will be better understood from a study of the specification hereinafter with reference to the attached drawings.

DETAILED DESCRIPTION

Figure 1:
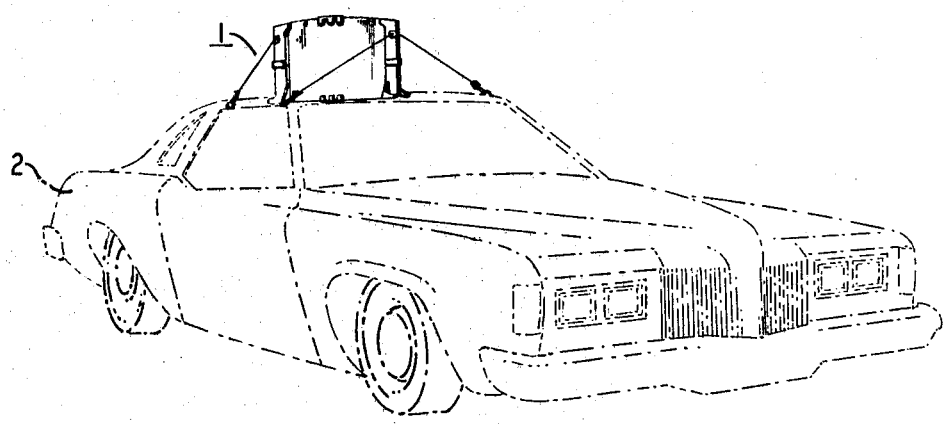
FIG. 1 is a showing, in phantom, of a typical vehicle on which a sign assembly is mounted in accordance with the present invention.

Referring to the drawings, FIG. 1 shows (in phantom) a conventional vehicle 2 on the top of which is fastened a sign assembly 1 in accordance with the present invention. Preferably, the principal axis of the assembly 1 is aligned with the principal axis of the vehicle, centered about halfway between the front and rear of the vehicle top.

Figure 2:
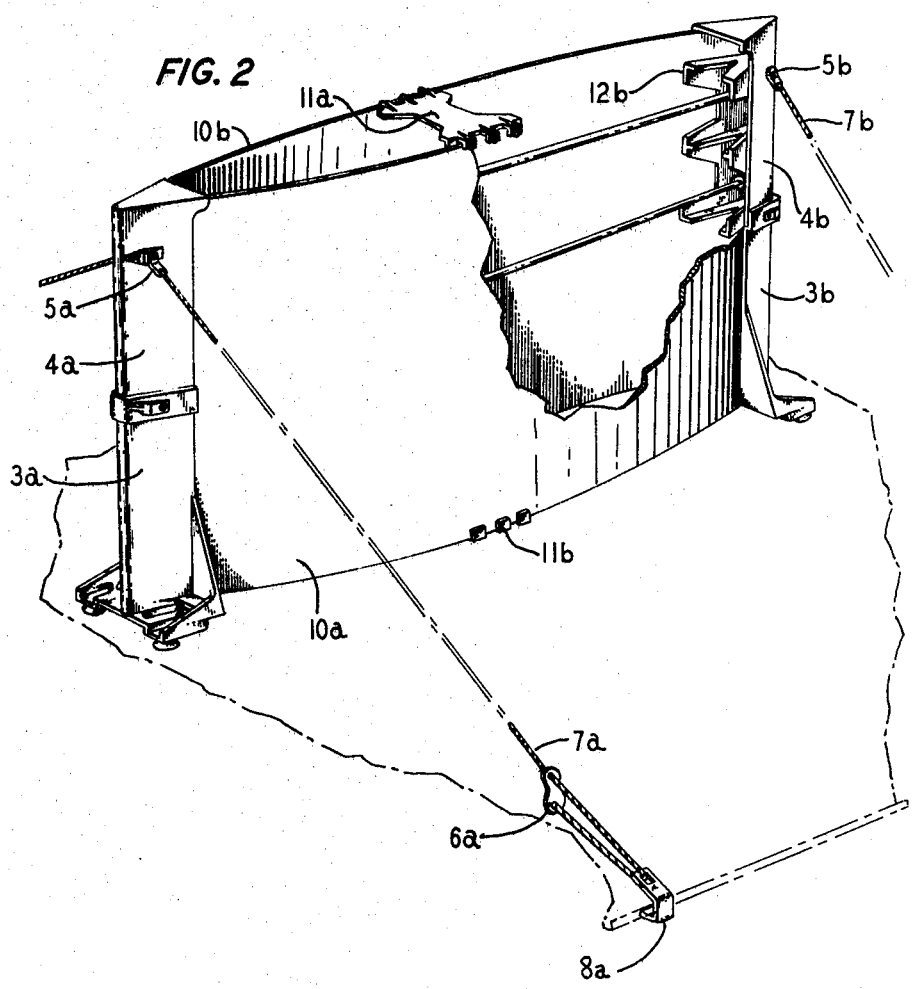
FIG. 2 is an enlarged showing, in perspective, of the sign assembly of FIG. 1 as mounted.

FIG. 2 is an enlarged showing of the sign assembly of the present invention comprising a pair of vertically extended corner support members 3*a*, 3*b*, V-shaped in horizontal section, aligned with their open ends facing along the long axis of the car roof, roughly 40 inches apart. Bolted or otherwise rigidly secured to the upper ends of each of the corner support members 3*a*, 3*b* are support extensions 4*a*, 4*b* of substantially matching cross-section. In the embodiment under description, these parts are formed of what is known as high impact polystyrene (white), in general 0.09 inch thick; although, it will be understood that these parts can be formed of any suitable rigid plastic so characterized as to withstand the stresses involved or, alternatively, of metal or even wood. Near the top, at each side of the support extensions 4*a*, 4*b*, is respectively disposed a pair of supporting bosses for bolt connectors 5*a*, 5*b*, on which is mounted a pair of upper tent slide connectors. (Matching bosses and bolt connectors 5*c*, 5*d*, not shown, are placed in symmetrical positions on the opposite sides.) Four nonstretchable guy cords 7*a*, 7*b* (7*c*, 7*d* not shown) are respectively connected between the upper tent slide connectors fastened to bolt connectors 5*a*, 5*b*, 5*c*, 5*d* and four lower tent slide connectors 6*a* (6*b*, 6*c*, 6*d* not shown). The latter are secured to four corresponding hooks 8*a* (8*b*, 8*c*, 8*d* not shown) which are fastened on the gutters on both sides of the vehicle roof, near the rear and front ends, respectively.

The opposite vertical edges of a pair of rectangular signs 10*a*, 10*b* are accommodated in corner supports 3*a*–4*a* at one edge and 3*b*–4*b* at the opposite edge. Signs 10*a*, 10*b*, which may, for example, be of white, high impact polystyrene, 36 to 40 inches long by 19 inches wide and 0.06 inch thick, have a matte surface suitable for silk screening. Or, for example, they may be formed of any other suitable plastic material or, alternatively, of cardboard, metal or even wood. Signs 10*a*, 19*b* are held in spaced-apart relation by gripping means on the upper and lower spreader members 11*a* and 11*b* which bear on the upper and lower edges of the signs. A pair of wedge members 12*a*, 12*b* is vertically disposed near opposite ends inside of the frame assembly, between signs 10*a*, 10*b*, to accommodate the signs in sandwich relation to the inside of the corner support members 3*a*, 4*a* on one side and 3*b*, 4*b* on the other side.

Figure 3A:
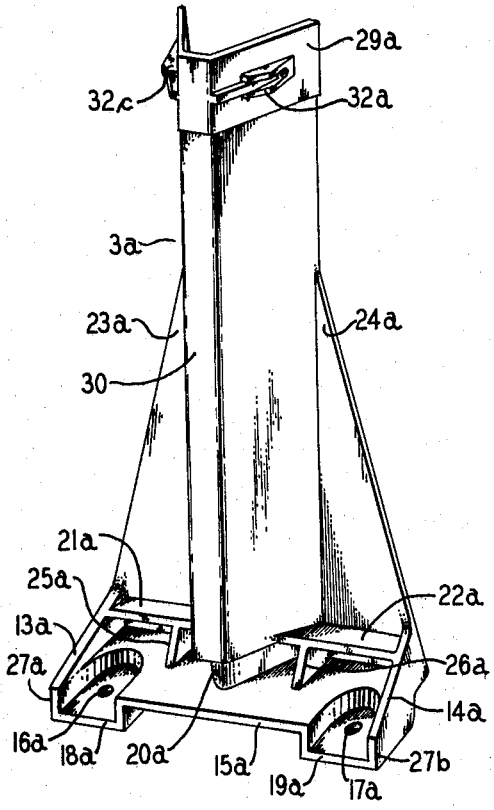
FIG. 3A is an enlarged perspective showing of the lower section of one of the external corner supports of the sign assembly of the present invention, together with the mounting base.

The components of the sign assembly will now be described in greater detail. FIG. 3A is a detailed perspective showing of the corner support member 3a, the support member 3b being substantially similar except for a left-to-right symmetry. In the example under description, the latter is 9½ inches in height, including the supporting base 15a which is designed to be bolted by conventional bolts 16a, 17a onto a pair of conventional suction cups which are mounted on the roof top of vehicle 2 on which they act as buffers.

The horizontal supporting base 15a, which in the example under description extends 5⅛ inches laterally, is supported on rectangular hollow feet 27a, 27b. Each of these contains a well 1¼ inches wide, 1½ inches from front to back and ½ inch deep, for accommodating bolts 16a and 17a near the centers. Base 15a is 2 inches deep, and has short side walls 13a, 14a, the top edges of which form angles of about 23°, front to back, with the plane of base 15a.

Centered on the supporting base 15a is a flat isosceles triangular projection 20a which is 7/16 inch thick above the base of 15a, its sides forming angles of roughly 35° with the principal horizontal axis of the assembly. Supported in cantilever fashion above 20a is the principal vertical member of the corner support 3a, taking the form of an outwardly projecting V having vertically extending sides, the inner faces of which form 23° angles with the principal axis of the assembly. The truncated apex 30 of the V is centered 3/16 inch behind the front edge of base 15a, forming a flat vertical strip 11/64 inch wide and 3/16 inch thick. Integral with the rear edges of corner support 3a is a pair of right-angular buttressing supports 23a, 24a which extend out about 1¼ inches from each side at the base of the V. These are integrally joined to the respective sides 13a and 13b, and are supported at the rear of a pair of ⅜ inch wide horizontal struts 21a, 22a which are respectively fixed at their edges to the sides 13a, 13b, and are further respectively supported above the plane of base 15a by a pair of edgewise slats 25a, 26a. The inner ends of the struts 21a, 22a are each slightly curved through a ½ inch radius, so that they bear tangentially on the opposite external vertical faces of support member 3a, adjacent the internal open end.

About one inch down from the top of the V-section support member 3a is an external shoulder 29a which has a matching internal shoulder. Centered about ½ inch down from the top on each outside face of 3a, and at a position, say, ⅞ inch on each side of the truncated apex 30, are bosses supporting conventional-type bolt-latch connectors 32a, 32c.

Figure 3B:
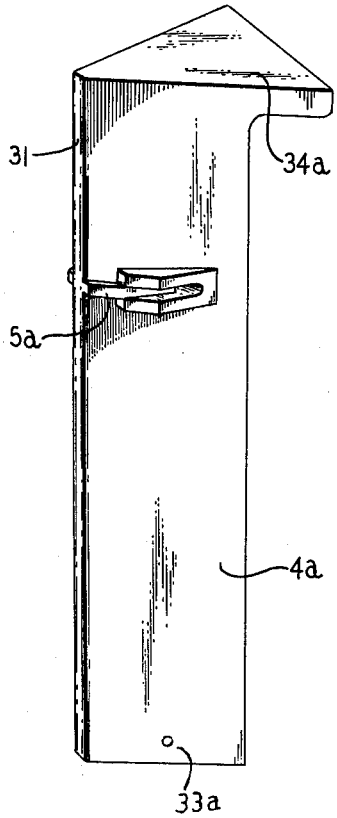
FIG. 3B is an enlarged perspective showing of the upper section which is designed to be bolted onto the top of the corner support shown in FIG. 3A.

Referring to FIG. 3B, there is shown a vertical extension 4a which is designed to be bolted on top of the corner support 3a. It will be understood that the vertical extension 4b is substantially similar to 4a, except that it is left-to-right symmetrical. Extension 4a is 10⅝ inches in overall height. The cross-section is V-shaped, characterized by a body portion substantially similar in material and cross-sectional shape to that of corner support 3a, each V face being 1 13/16 inches wide. A pair of 5/16 inch diameter holes 33a, 33c (not shown) are centered ½ inch above the bottom edge and ⅞ inch from the truncated apex 31, on opposite faces of extension 4a. These holes are so positioned that when 4a is mounted on top of 3a, with its lower edge resting on the inner shoulder of the latter, parallel to 29a, the holes 33a and 33c are exactly positioned to receive the bolts from connectors 32a, 32c, so that the upper and lower sections 4a–3a may be securely latched together. Near the top of 4a, the width of each of the V-related faces is increased to 2⅞ inches, this width extending down ⅜ inch.

At the top of 4a is a flat triangular closure plate 34a, having sides 3⅛ inches long and a base 2¾ inches long.

Figure 4:
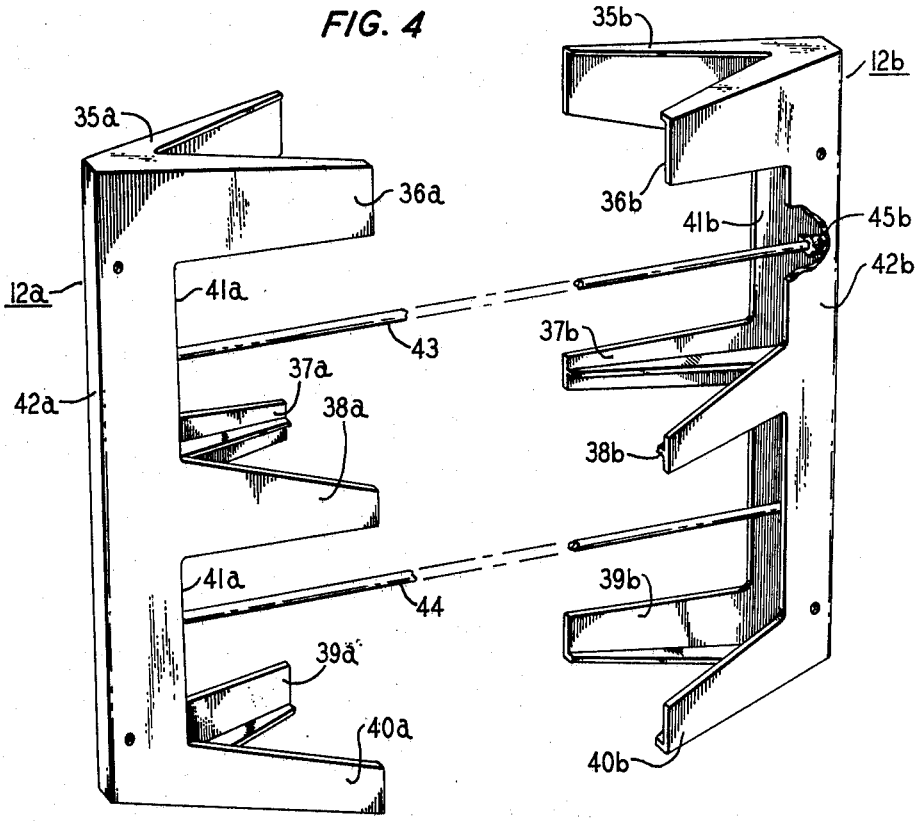
FIG. 4 show, in perspective, the wedge-shaped inner supporting members of the sign assembly of FIG. 1.

FIG. 4 of the drawings shows the two components of the wedge-shaped, inner supporting means 12a, 12b. The latter are preferably formed of 0.08 inch thick, high impact polystyrene, opaque (white); however, they may comprise any suitable rigid plastic material or, alternatively, metal or even wood. Each of these is 10 inches in overall height. Since the two components are characterized by left-to-right symmetry, 12a only will be described. As in the case of the corner supports 3a–4a, the section of 12a is V-shaped, truncated at the apex 42a, forming a flat vertical strip 0.565 inch wide extending the height of the member. The external faces of the V form an angle of 23° with the principal axis. The wedge member 12a has three sets of symmetrically disposed, outwardly directed fins 35a, 36a at the top; 37a, 38a in the middle; and 39a, 40a at the bottom. The vertical faces of these fins are disposed at external angles of 23° with the axis in a horizontal plane, forming a truncated isosceles triangle 3½ inches across the base and having sides 3¾ inches wide. The internal angles in a horizontal plane between each of the faces and the axis are 30°. The internal angles are each rounded at the inner apex, which is one inch along the axis from the truncated external apex 42a. The top and bottom fins 35a, 36a and 39a, 40a are each one inch in vertical extent at their ends, broadening out to 1½ inches in vertical extent where they join the body portion 41a, the edges forming angles of 15° with the horizontal. The center fins 37a, 38a are ⅝ inches in vertical extent at their ends, and 1⅜ inches where they join body portion 41a, the edges respectively forming positive and negative angles of 10° with the horizontal. The vertical sides of body portion 41a, represented by the cutouts between the upper and middle, and the lower and middle fins, are approximately one inch wide in the horizontal plane.

Located halfway between the upper and middle fins, internally on truncated apex 46b, is hole 45b, 9/16 inch in diameter, a corresponding hole 45a (not shown). A similar pair of holes is located between the lower and middle fins. The area surrounding the holes is filled in to provide reinforcement. The function of these holes is to accommodate the ends of a pair of upper and lower dowels 43 and 44, which are ½ inch in diameter and, say, 37 7/16 inches in length, should such members 42a, 42b need further support. These dowels may be rigid plastic or wood, the length being adjustable.

Pairs of ⅜ inch diameter holes are respectively centered 0.268 inch in a horizontal plane from truncated apex 42a, adjacent the lower end of the upper fins, and the upper end of the lower fins. These may serve for bolting the inner wedge members and outer support members together with the two signs 10a, 10b as required.

The signs 10a, 10b, which are rectangular, say, 36 inches to 40 inches long, and 19 inches wide, are taped together at their short edges.

Using the corner support members 4a–3a and 4b–3b, the positions of the bolt fittings 5a, 5b and 32a, 32b are marked; and four ½ inch holes are cut in the taped together signs 10a, 10b. The latter are then bolted into place inside of the corner supporting members 4a–3a and 4b–3b. The wedge members 12a and 12b are then interposed into opposite corners with the signs 10*a*, 10*b* sandwiched between the wedges and corner supports. The bolts are then extended through the openings in wedges 12*a*, 12*b* and the ends are secured, say, by tightening a wing nut on each bolt.

In order to maintain the signs 10*a*, 10*b* in proper spread-apart relation, the upper and lower spreaders 11*a*, 11*b* are interposed. Sign 10*a* is threaded into the upper and lower grippers on one side; and sign 10*b* is threaded into the upper and lower grippers on the other side.

Spreader 11*a* is shown in FIGS. 5A, 5B, 5C and 5D of the drawings, spreader 11*b* being substantially identical. In the present illustrative embodiment, this unit is formed of high impact polystyrene (opaque white) having walls 0.08 inch thick, except as otherwise indicated. It will be understood, however, that any suitable rigid plastic material can be substituted. Alternatively, metal or wood or any other suitable materials can be employed. The overall length of the horizontal coupling member of spreader unit 11*a*, in a direction normal to the principal axis of the assembly, is 8 inches; and the width in the direction of the principal axis of the central body portion 50*a* is 2 inches. The edge portions 51*a* and 51*c* are 4½ inches long. The width of 11*a* is cut back toward the center at angles of 30°, ½ inch from each of the edges. Inasmuch as the two sides are right-to-left symmetrical, only 51*a* will be described.

Figure 5A:
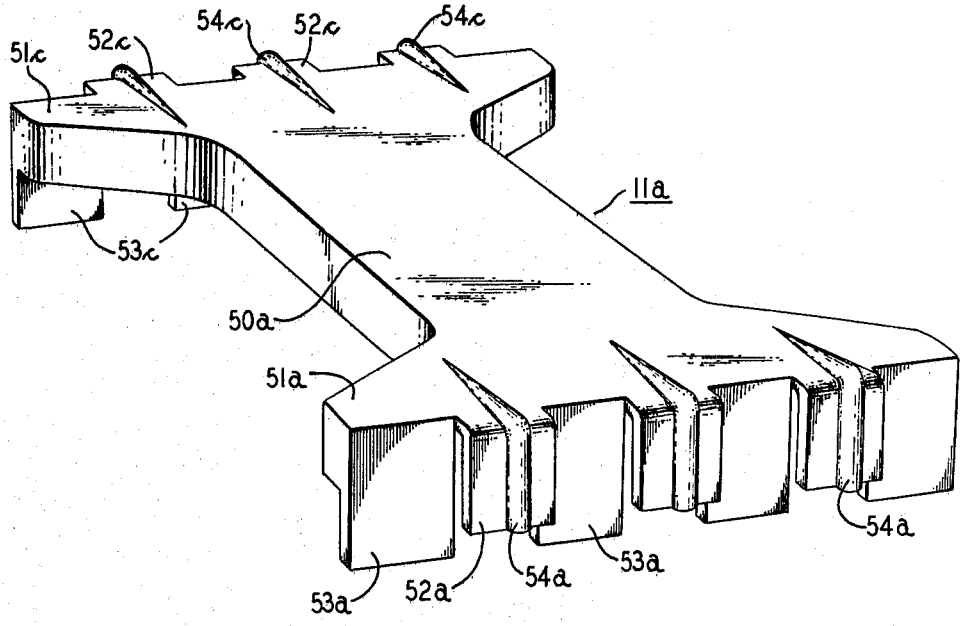
FIG. 5A is a perspective showing of one of the spreaders of FIG. 2.
Figure 5B:
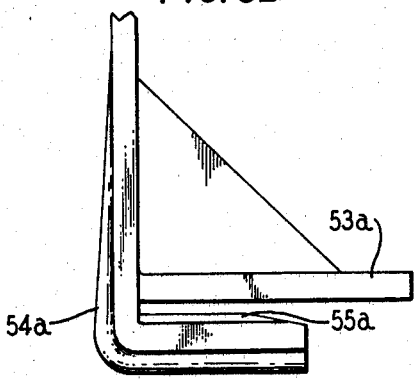
FIGS. 5B, 5C and 5D are, respectively, enlarged showings of the cross-sectional view, plan view and bottom view of one of the grippers of FIG. 5A.
Figure 5C:
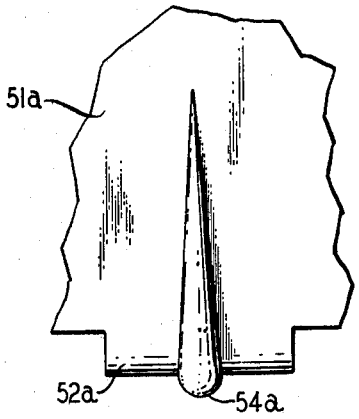
Figure 5D:
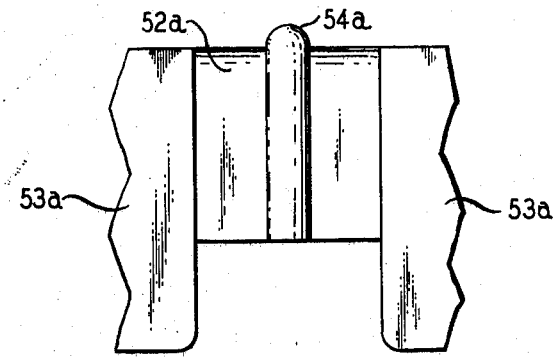

The top edge of sign 10*a* is sandwiched between a series of rear panels 53*a;* and a series of front panels 52*a*, depending from the lateral edge of 51*a* in alternation, along two planes parallel to the face of the sign. Rear panels 53*a* are 11/16 inch wide and one inch long. Front panels 52*a* are laterally spaced apart 0.06 inch from rear panels 53*a* to provide slots to accommodate the top edge of sign 10*a*. Front panels 52*a* are ⅝ inch wide and ⅝ inch long. Centered on each of front panels 52*a* is a spring-like finger 54*a*, 3/32 inch in diameter, which is fixed to the surface of 51*a*, extending about ¾ inch back from the edge and extending vertically downward ⅝ inch on the front face of each of the panels 52*a*. This provides spring-like action to hold the sign 10*a* sandwiched in the slot between 53*a* and 52*a*. This is clearly shown in FIGS. 5B and 5C. When needed to insure a tight fit on the signboard, additional vertical spacers 55*a*, which are 0.005 inch thick, are inserted along the centers of the rear surfaces of each of the fingers 54*a*. This is shown in FIG. 5B.

It will be understood that the present invention is not limited to the specific forms, dimensions or materials recited herein by way of illustrative example, but only by the scope of the appended claims.

What is claimed is:

1. A vehicle-top sign assembly for displaying a pair of signs disposed edgewise in arched back-to-back relation, said assembly including:

a pair of corner supports each comprising a pair of vertically extended planes forming between them an open acute internal angle, said corner supports constructed to be fastened in spaced-apart relation on said vehicle top with their open angular ends in opposed relation to accommodate opposite lateral edges of the signs of said pair, means for maintaining the lateral edges of said signs in rigid edgewise position inside of said corner supports comprising a pair of vertically extended wedge-shaped members, the bodies of said wedge-shaped members each comprising a pair of faces disposed at an external angle approximating the acute internal angle of a respective one of said corner supports, means for supporting the respective edge portions of each of said signs in sandwich relation between one of the inner faces of said corner supports and a corresponding external face of one of said wedge-shaped members, spreader means imposed transversely across said assembly including said signs, in a horizontal plane in an area intermediate between said corner supports, each said spreader means including a pair of grippers respectively disposed to engage corresponding horizontal edge portions of each of said signs for securing the centers of said signs in back-to-back relation, wherein said spreader means comprise an upper and a lower member each including a horizontally disposed coupling bar, said grippers being integral with the ends of said coupling bar and extending in a direction substantially normal to the plane of said coupling bar, each of said grippers including two series of vertical panels disposed in slightly off-set relation to form between them a series of aligned slots constructed to accommodate the respective upper and lower horizontal edges of said signs.

2. The combination in accordance with claim 1 wherein said two series of panels comprise an internal series and an external series defining between them said slots, and wherein each of the panels of said external series includes a transversely extending finger connected at one end adjacent an edge portion of said horizontally-disposed coupling bar and bearing at the other end on the external face of said panel, said finger constructed and arranged to provide spring action by impelling said panel against the external surface of said sign.

3. The combination in accordance with claim 2 wherein each of the elements of said assembly is formed of semirigid plastic material.

4. The combination in accordance with claim 3 wherein said plastic material comprises primarily high impact polystyrene.

5. The combination in accordance with claim 1 wherein each of said wedge-shaped members includes a plurality of lateral fins, extended along vertical planes conforming to the external planes of the body of said wedge-shaped member and substantially parallel to the plane of a respective one of said signs, said fins being constructed to contact the inner surfaces of said signs for maintaining said signs in arched back-to-back relation in said assembly.

6. The combination in accordance with claim 1 wherein said corner supports include connecting means for rigidly connecting said corner supports to said wedge-shaped members in sandwich relation to said signs.

7. The combination in accordance with claim 6 wherein said connecting means include means for connecting guy wires to secure said corner supports in relation to said vehicle top.

8. The combination in accordance with claim 1 wherein each of said corner supports comprises a supporting base constructed to be fastened to said vehicle top, means rigidly mounted on each said supporting base comprising a pair of horizontally disposed struts and a pair of vertically disposed laterally extending triangular buttressing members, each said strut and a corresponding buttressing member rigidly connected to a lower external vertical face of a respective one of said corner supports adjacent the open end of said corner support, thereby providing cantilever-type support for said corner supports.

* * * * *